US012146246B2

(12) United States Patent
Dombrow et al.

(10) Patent No.: US 12,146,246 B2
(45) Date of Patent: Nov. 19, 2024

(54) FOOTWEAR INCLUDING A TEXTILE UPPER

(71) Applicant: Under Armour, Inc., Baltimore, MD (US)

(72) Inventors: David Dombrow, Baltimore, MD (US); Kevin P. Fallon, Portland, OR (US); Thomas White, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 766 days.

(21) Appl. No.: 15/149,602

(22) Filed: May 9, 2016

(65) Prior Publication Data

US 2017/0020229 A1 Jan. 26, 2017

Related U.S. Application Data

(60) Provisional application No. 62/158,709, filed on May 8, 2015.

(51) Int. Cl.
*A43B 23/02* (2006.01)
*A43B 1/04* (2022.01)
(Continued)

(52) U.S. Cl.
CPC ..... *D04B 1/24* (2013.01); *A43B 1/04* (2013.01); *A43B 23/02* (2013.01); *A43B 23/0235* (2013.01); *A43B 23/0255* (2013.01); *A43B 23/086* (2013.01); *D04B 1/123* (2013.01); *D04B 1/14* (2013.01); *D04B 1/16* (2013.01);
(Continued)

(58) Field of Classification Search
CPC ..... A43B 23/028; A43B 5/06; A43B 1/04; A43B 23/088; A43B 7/085; A43B 23/0245; A43C 1/04; A43C 5/00; D04B 1/22; D04B 1/123; D04B 1/16; D10B 2401/041
See application file for complete search history.

(56) References Cited

U.S. PATENT DOCUMENTS 371,394 A 10/1887 Warren
625,331 A 5/1899 Daut
(Continued)

FOREIGN PATENT DOCUMENTS

EP 0632972 B1 9/1996
EP 1130146 A4 9/2004
(Continued)

OTHER PUBLICATIONS

Thermal Conductivity of some common Materials and Gases' (The Engineering Toolbox) Jan. 7, 2015 (Jan. 7, 2015) [online] retrieved from URL:https://web.archive.org/web/20150107151233/http://www.engineeringtoolbox.com/thermal-conductivity-d_429.html> pp. 2-3.
(Continued)

*Primary Examiner* — Katharine G Kane
(74) *Attorney, Agent, or Firm* — Edell, Shapiro & Finnan, LLC

(57) ABSTRACT

An article of footwear includes a sole structure and an upper attached to the sole structure. The upper is formed from a textile including interlocked strands oriented in a predetermined configuration. The strands include one or more inelastic strands operable to provide stretch and/or recovery properties to the upper.

3 Claims, 11 Drawing Sheets

(51) Int. Cl.

| | |
|---|---|
| ***A43B 23/08*** | (2006.01) |
| ***D04B 1/02*** | (2006.01) |
| ***D04B 1/12*** | (2006.01) |
| ***D04B 1/14*** | (2006.01) |
| ***D04B 1/16*** | (2006.01) |
| ***D04B 1/22*** | (2006.01) |
| ***D04B 1/24*** | (2006.01) |
| *A43B 5/06* | (2022.01) |
| *A43B 7/08* | (2022.01) |
| *A43C 1/00* | (2006.01) |
| *A43C 1/04* | (2006.01) |

(52) U.S. Cl.

CPC ..... *D04B 1/22* (2013.01); *A43B 5/06* (2013.01); *A43B 7/085* (2013.01); *A43B 23/0205* (2013.01); *A43B 23/0275* (2013.01); *A43B 23/028* (2013.01); *A43C 1/00* (2013.01); *A43C 1/04* (2013.01); *D10B 2401/041* (2013.01); *D10B 2403/02* (2013.01); *D10B 2501/043* (2013.01)

(56) References Cited

U.S. PATENT DOCUMENTS 712,003 A 10/1902 Payne
913,012 A 2/1909 Jackson
914,406 A 3/1909 Gardner
1,309,271 A 7/1919 Zapis
1,697,893 A 1/1929 Edward
1,862,047 A 6/1932 Boulet et al.
RE18,804 E 4/1933 Joha
D90,369 S 7/1933 Ludwick
2,147,197 A 2/1939 Glidden
2,230,915 A 2/1941 Spiro
2,314,098 A 3/1943 McDonald
2,334,659 A 11/1943 Arsdale et al.
2,335,210 A 11/1943 Guinzberg
2,345,055 A 3/1944 Lilley et al.
2,345,057 A 3/1944 Edward
2,369,254 A 2/1945 John
2,400,692 A 5/1946 Herbert
2,420,239 A 5/1947 Hack
2,440,393 A 4/1948 Clark
2,467,237 A 4/1949 Sherman et al.
2,495,984 A 1/1950 Roy
2,538,673 A 1/1951 Donahue
2,586,045 A 2/1952 Hoza
2,636,287 A 4/1953 Heilbronner
2,641,004 A 6/1953 Whiting et al.
2,675,631 A 4/1954 Doughty
2,679,117 A 5/1954 Reed
3,093,916 A 6/1963 Hiestand et al.
3,546,796 A 12/1970 Adams
3,631,666 A * 1/1972 Kim ..... D02G 3/367 57/6
3,655,420 A * 4/1972 Tichenor ..... C08G 59/306 428/391
3,667,207 A * 6/1972 Ben ..... C08G 69/36 57/246
3,703,775 A 11/1972 Gatti
3,925,912 A 12/1975 Martineau
4,115,989 A * 9/1978 Spolnicki ..... D01F 8/14 28/257
4,232,458 A 11/1980 Bartels
4,245,408 A 1/1981 Larsen et al.
4,255,876 A 3/1981 Johnson
4,559,723 A 12/1985 Hamy et al.
4,670,949 A 6/1987 Autry
D292,941 S 12/1987 Kelley
4,756,098 A 7/1988 Boggia
4,785,558 A 11/1988 Shiomura
4,870,761 A 10/1989 Tracy
D309,822 S 8/1990 Barret
4,958,418 A 9/1990 Dufour
5,016,327 A 5/1991 Klausner
5,042,120 A 8/1991 Nichols
5,086,576 A 2/1992 Lamson
5,181,331 A 1/1993 Berger
5,184,378 A 2/1993 Batra
5,271,130 A 12/1993 Batra
5,282,846 A * 2/1994 Schmitt ..... A61F 2/06 600/36
5,345,638 A 9/1994 Nishida
5,365,677 A 11/1994 Dalhgren
5,371,957 A 12/1994 Gaudio
5,377,430 A 1/1995 Hatfield et al.
D375,617 S 11/1996 Orzeck
D377,414 S 1/1997 Hatfield
5,692,319 A 12/1997 Parker et al.
5,692,320 A 12/1997 Nichols
5,700,573 A * 12/1997 McCullough ..... D01F 8/08 423/447.1
5,784,806 A 7/1998 Wendt
5,811,186 A * 9/1998 Martin ..... B24D 11/005 428/373
5,965,223 A 10/1999 Andrews et al.
6,052,921 A 4/2000 Oreck
D428,239 S 7/2000 Plamondon
6,108,943 A 8/2000 Hudson et al.
D438,697 S 3/2001 Matis
D444,624 S 7/2001 Wilson
D447,858 S 9/2001 Matis
6,298,582 B1 10/2001 Friton et al.
D458,015 S 6/2002 Dolan
6,401,364 B1 6/2002 Burt
6,677,038 B1 * 1/2004 Topolkaraev ..... D01F 8/06 428/370
D494,353 S 8/2004 McDowell
6,880,268 B2 4/2005 Chen
6,910,288 B2 6/2005 Dua
6,931,762 B1 8/2005 Dua
6,986,269 B2 1/2006 Dua
D520,225 S 5/2006 Choi
D521,226 S 5/2006 Douglas
7,051,460 B2 5/2006 Orei et al.
D526,771 S 8/2006 Fallon
7,131,296 B2 11/2006 Dua et al.
D545,557 S 7/2007 Caine
D549,441 S 8/2007 Chang
D551,841 S 10/2007 Choi
7,338,877 B1 * 3/2008 Meyer ..... D01D 5/34 428/373
7,347,011 B2 3/2008 Dua et al.
D572,453 S 7/2008 Alfaro
D574,591 S 8/2008 Belley
D578,294 S 10/2008 Mervar
7,624,517 B2 12/2009 Smith
7,627,963 B2 12/2009 Kilgore
7,634,861 B2 12/2009 Kilgore
7,637,032 B2 12/2009 Sokolowski et al.
7,774,956 B2 8/2010 Dua et al.
D624,297 S 9/2010 Henderson
7,793,436 B2 9/2010 Sink
7,814,598 B2 10/2010 Dua et al.
7,823,298 B2 11/2010 Nishiwaki et al.
D636,569 S 4/2011 McMillan
D636,584 S 4/2011 Williams, Jr.
D639,543 S 6/2011 Lamont
8,028,440 B2 10/2011 Sokolowski et al.
8,042,288 B2 10/2011 Dua et al.
D661,884 S 6/2012 Raysse
8,209,883 B2 7/2012 Lyden
8,215,132 B2 7/2012 Dua et al.
8,241,651 B2 * 8/2012 Lahann ..... A61K 9/1694 424/422
8,266,749 B2 9/2012 Dua et al.
8,272,148 B2 9/2012 Nishiwaki et al.
D668,858 S 10/2012 Shaffer
8,448,474 B1 5/2013 Tatler et al.
8,590,345 B2 11/2013 Sokolowski et al.
8,595,878 B2 12/2013 Huffa et al.
8,621,891 B2 1/2014 Dua et al.

(56) References Cited

U.S. PATENT DOCUMENTS 8,650,916 B2 2/2014 Dua et al.
8,701,232 B1 4/2014 Droege et al.
D707,436 S 6/2014 Seamarks
D707,943 S 7/2014 Nascimento
D707,947 S 7/2014 Seamarks
D709,280 S 7/2014 Shaffer
8,800,172 B2 8/2014 Dua et al.
8,839,532 B2 9/2014 Huffa et al.
8,881,430 B2 11/2014 Seamarks et al.
8,898,931 B2 12/2014 Gerber
D722,226 S 2/2015 Williams, Jr.
8,950,088 B2 2/2015 Aveni et al.
8,959,959 B1 2/2015 Podhajny
8,973,288 B2 3/2015 Dojan et al.
8,973,410 B1 3/2015 Podhajny
8,997,529 B1 4/2015 Podhajny
9,032,763 B2 5/2015 Meir et al.
D731,765 S 6/2015 Opie
9,060,562 B2 6/2015 Meir et al.
D735,465 S 8/2015 Petrie
D737,552 S 9/2015 Guichot
D738,085 S 9/2015 Kirschner
D738,089 S 9/2015 Avar
9,149,086 B2 10/2015 Greene et al.
9,150,986 B2 10/2015 Dua et al.
9,192,204 B1 11/2015 Liles et al.
D748,389 S 2/2016 Small
D753,376 S 4/2016 Birkinhead
9,404,205 B2 8/2016 Meir
D765,964 S 9/2016 Fallon
D772,553 S 11/2016 Williams, Jr.
9,491,987 B2 11/2016 Antonelli et al.
9,510,637 B2 12/2016 Podhajny et al.
9,578,928 B2 2/2017 Farris
2002/0010988 A1 1/2002 Cretinon
2002/0166260 A1 11/2002 Borsoi
2004/0110442 A1* 6/2004 Rhim ..... D04H 3/14 442/361
2004/0118018 A1* 6/2004 Dua ..... A43B 1/04 36/45
2004/0181972 A1 9/2004 Csorba
2005/0022427 A1 2/2005 Kerns et al.
2005/0193592 A1 9/2005 Dua
2005/0198866 A1 9/2005 Wiper et al.
2006/0053658 A1 3/2006 Dee
2007/0068041 A1 3/2007 Farys
2008/0110048 A1 5/2008 Dua et al.
2009/0100717 A1 4/2009 Cabanis
2009/0126231 A1 5/2009 Maimivaara
2009/0277043 A1 11/2009 Graser et al.
2010/0051132 A1* 3/2010 Glenn ..... A41C 3/12 139/387 R
2010/0064547 A1 3/2010 Kaplan et al.
2010/0107443 A1 5/2010 Aveni
2011/0003524 A1* 1/2011 Claasen ..... C08F 10/00 442/329
2011/0041232 A1* 2/2011 Covelli ..... A41F 9/00 2/69
2011/0113648 A1 5/2011 Leick et al.
2011/0225843 A1 9/2011 Kerns et al.
2011/0283435 A1* 11/2011 Smith ..... D01F 1/10 2/69
2012/0055044 A1 3/2012 Dojan et al.
2012/0255201 A1 10/2012 Little
2013/0019501 A1 1/2013 Gerber
2013/0318837 A1 12/2013 Dua et al.
2014/0130372 A1 5/2014 Aveni et al.
2014/0130373 A1 5/2014 Baines et al.
2014/0137434 A1 5/2014 Craig
2014/0150295 A1 6/2014 Dua et al.
2014/0196311 A1 7/2014 Follet et al.
2014/0223779 A1 8/2014 Elder et al.
2014/0237861 A1 8/2014 Podhajny
2014/0310983 A1* 10/2014 Tamm ..... A43B 23/024 36/83
2014/0325873 A1 11/2014 Inth
2014/0360050 A1 12/2014 Kohatsu et al.
2015/0013080 A1 1/2015 Thomas et al.
2015/0013187 A1 1/2015 Taniguchi et al.
2015/0033519 A1 2/2015 Hammerslag
2015/0047227 A1 2/2015 Fallon et al.
2015/0059211 A1 3/2015 Droege et al.
2015/0107307 A1 4/2015 Kosui et al.
2015/0216255 A1 8/2015 Podhajny
2015/0216256 A1 8/2015 Podhajny
2015/0320136 A1 11/2015 Dua et al.
2015/0342285 A1* 12/2015 Huffman ..... A43B 23/024 36/9 R
2016/0058099 A1* 3/2016 Panian ..... A43B 23/0265 36/84
2016/0095387 A1 4/2016 Follet et al.
2016/0286903 A1 10/2016 Whewell
2016/0302524 A1 10/2016 Smith
2016/0331084 A1 11/2016 Xanthos et al.
2017/0065028 A1 3/2017 Foster et al.
2017/0065029 A1 3/2017 Bordin
2017/0105487 A1 4/2017 Klein
2017/0105489 A1 4/2017 Lovett
2018/0110283 A1 4/2018 Brinkman

FOREIGN PATENT DOCUMENTS

EP 2792260 A3 12/2014
EP 2792264 A3 12/2014
EP 2792265 A3 12/2014
EP 2149629 B1 1/2015
GB 0012787 B2 6/1904

OTHER PUBLICATIONS

Written Opinion and International Search Report from Related PCT Application No. PCT/US16/031093 (mailed Aug. 31, 2016).
Supplementary European Search Report, EP16793231, date of completion Dec. 11, 2018, 8 pages.
Thermal Conductivity of Some Materials and Gases, XP055185305, downloaded from https://web.archive.org/web/2015031804 3824/http://www.engineeringtoolbox.com/thermal-conductivity-d_429.html, obtained Apr. 23, 2015, 11 pages.
Textile Innovation Knowledge Platform, http://www.tikp.eo.uk/knowledge/technology/knitting/priciples/, Dec. 29, 2013, 3 pages.

* cited by examiner

FOOTWEAR INCLUDING A TEXTILE UPPER

CROSS REFERENCE TO RELATED APPLICATIONS

The present application claims priority to Provisional Application No. 62/158,709, filed 8 May 2015 and entitled "Footwear Including a Textile Upper." The disclosure of the aforementioned application is incorporated herein by reference in its entirety.

FIELD OF THE INVENTION

The present invention relates to an article of footwear and, in particular, footwear including an upper with stretch properties.

BACKGROUND

Articles of footwear typically include an upper and a sole structure attached to the upper. When the upper is knitted, an elastomeric strand may be added to provide the upper with stretch and/or recovery properties. Adding elastomeric strands, however, adds weight to the upper (and thus the footwear), as well as increases water retention in the upper. Accordingly, it would be desirable to provide stretch properties to portions of an upper without utilizing elastomeric yarns.

SUMMARY OF THE INVENTION

An article of footwear includes a sole structure and an upper attached to the sole structure. The upper is formed from a textile including interlocked strands oriented in a predetermined configuration. The strands include one or more inelastic strands operable to provide stretch and/or recovery properties to the upper.

BRIEF DESCRIPTION OF THE DRAWINGS

Like reference numerals have been used to identify like elements throughout this disclosure.

DETAILED DESCRIPTION

Figure 1:
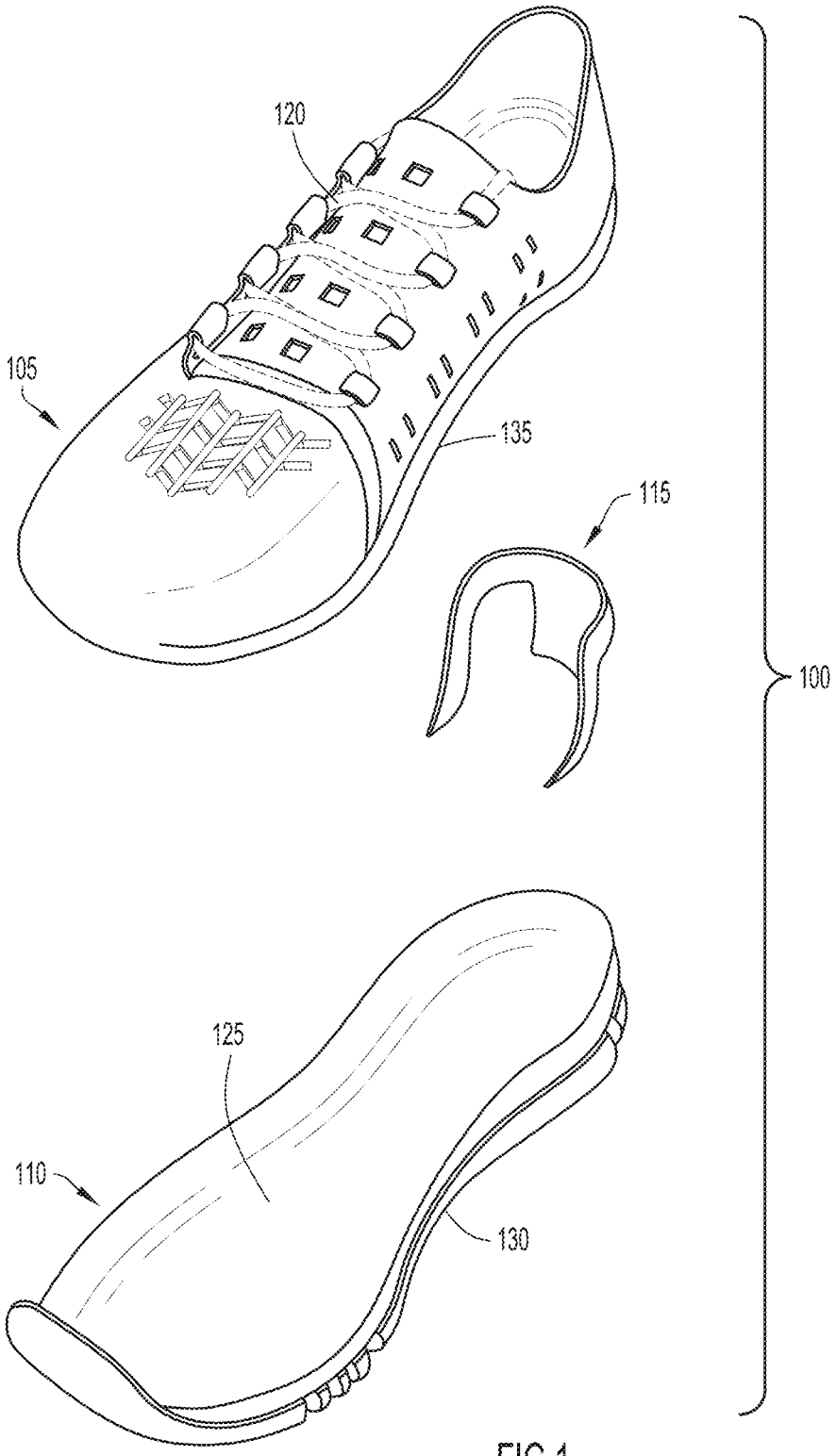
FIG. 1 is an exploded view of an article of footwear in accordance with an embodiment of the invention (footwear configured for a right foot).
Figure 2A:
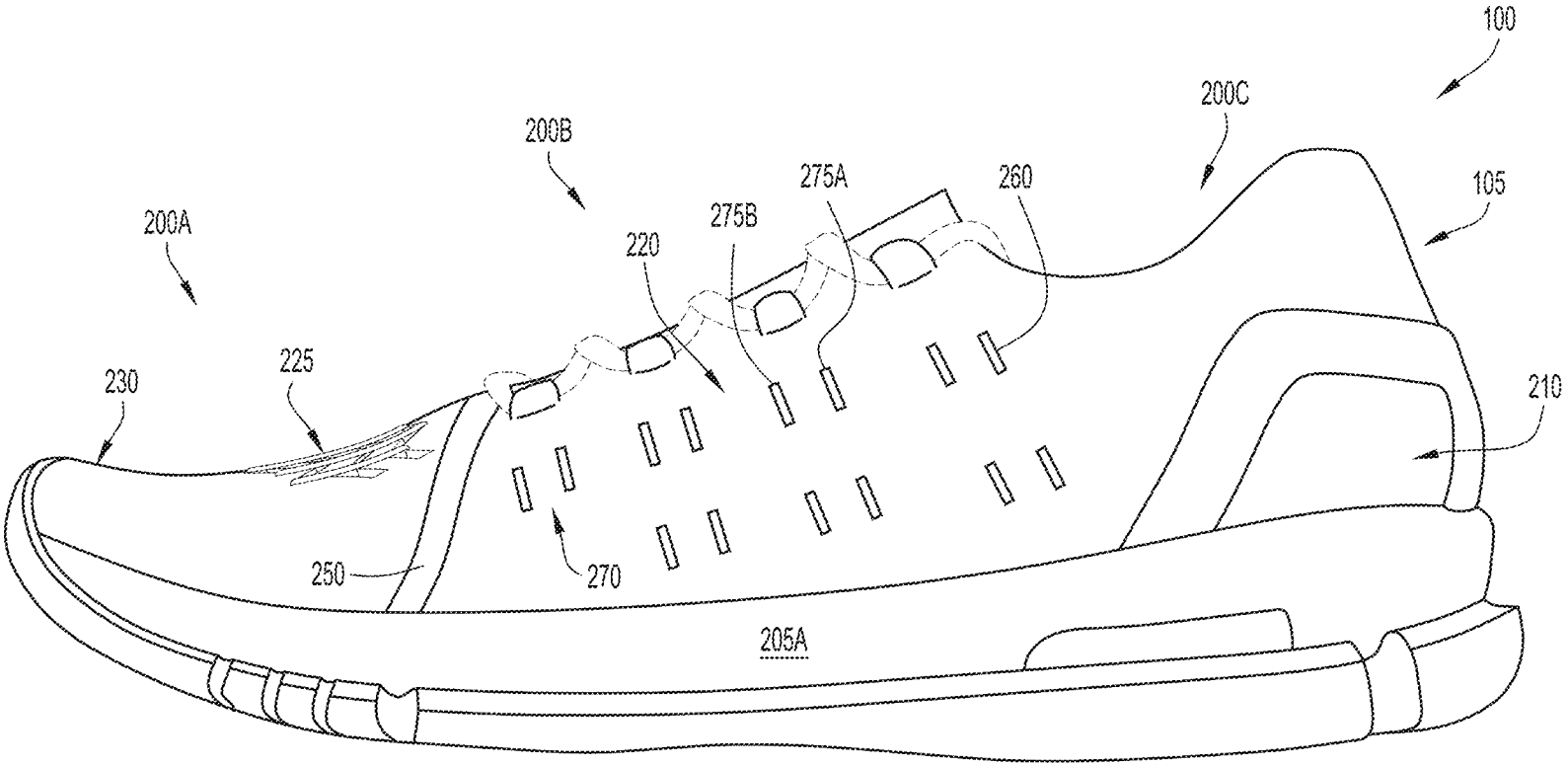
FIG. 2A is side view in elevation of the article of footwear shown in FIG. 1, showing the medial footwear side.
Figure 2B:
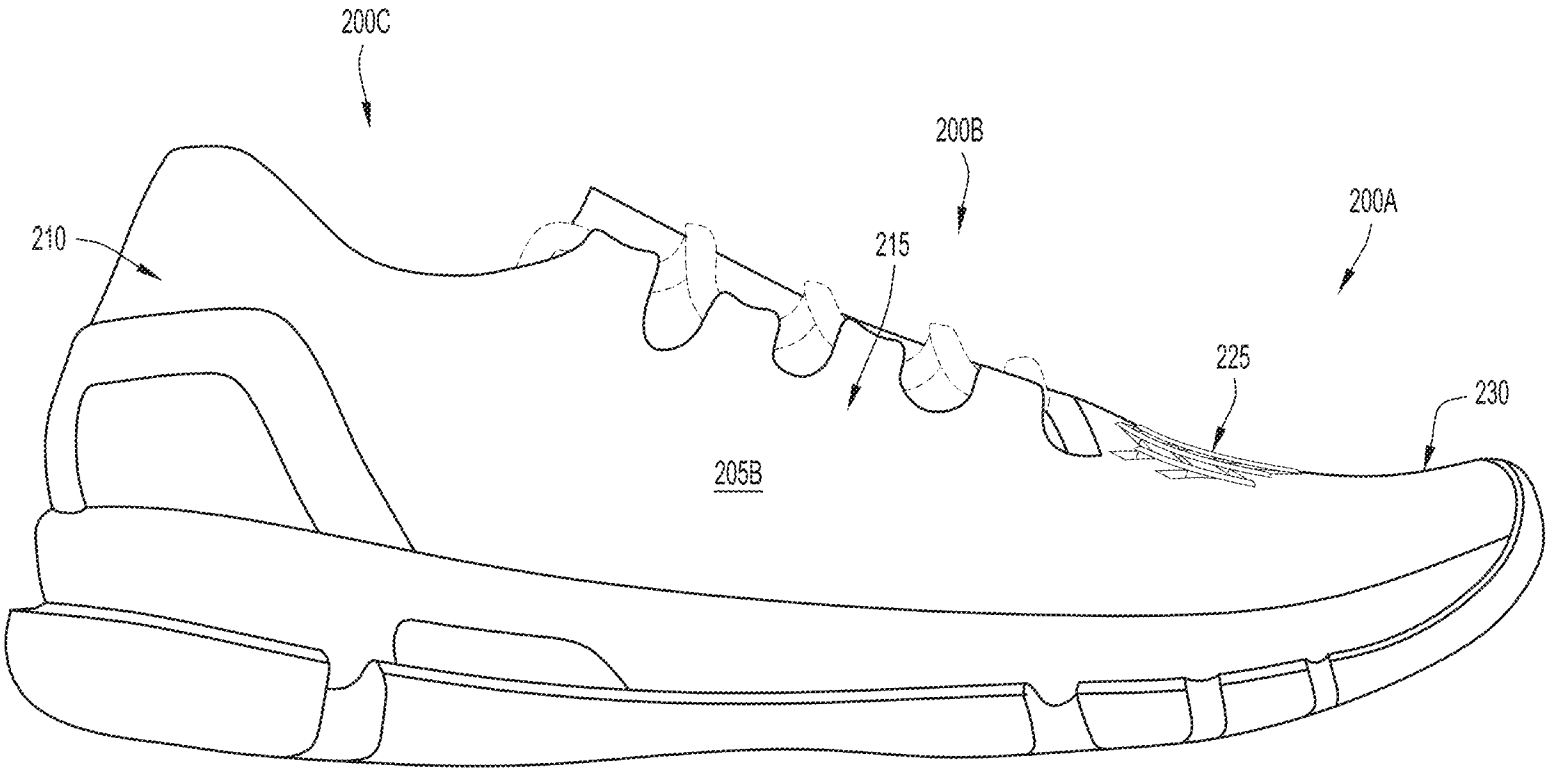
FIG. 2B is a side view in elevation of the article of footwear shown in FIG. 1, showing the lateral footwear side.
Figure 2C:
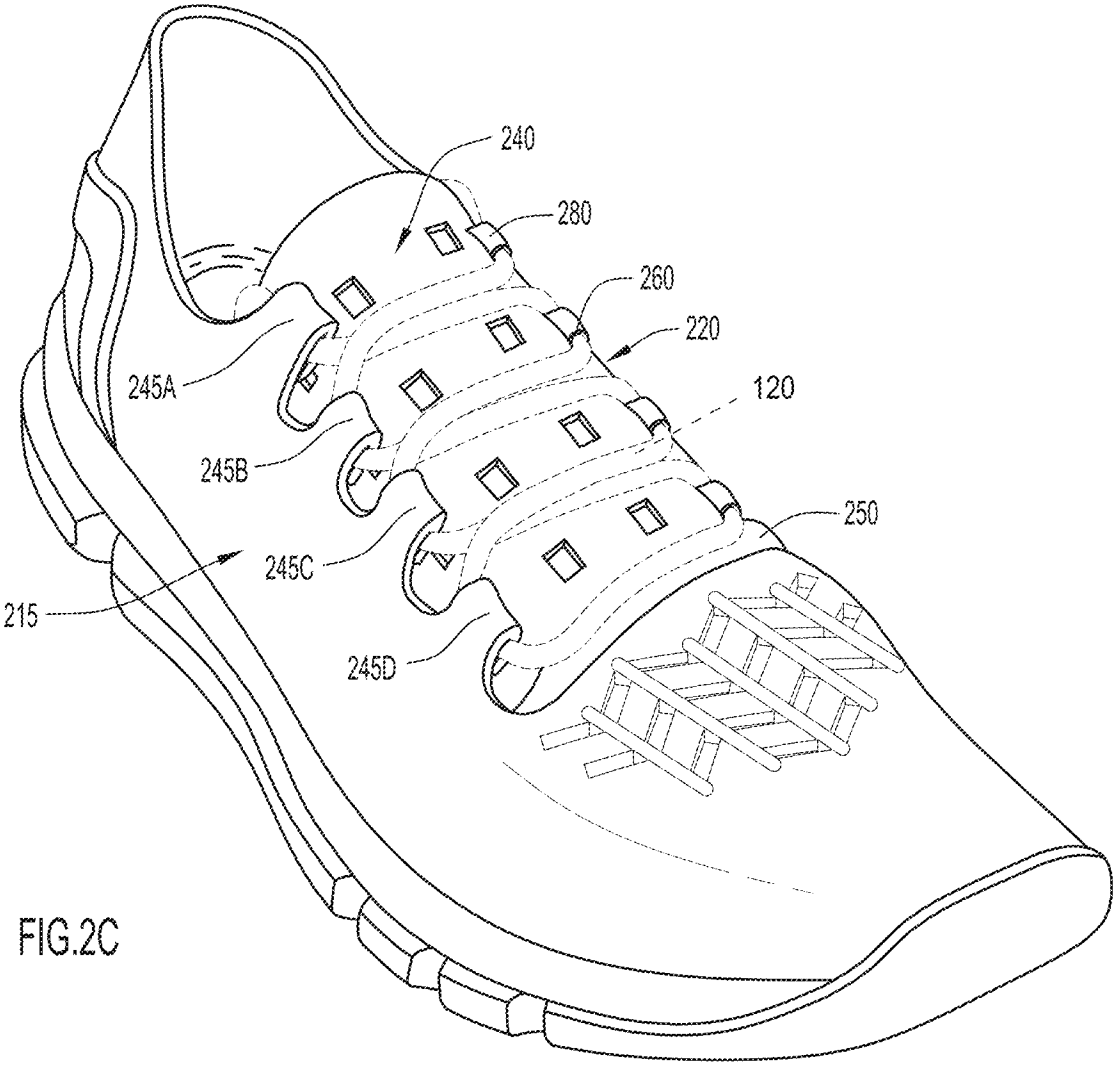
FIG. 2C is a front perspective view of the article of footwear of FIG. 1, showing the lateral footwear side.
Figure 2D:
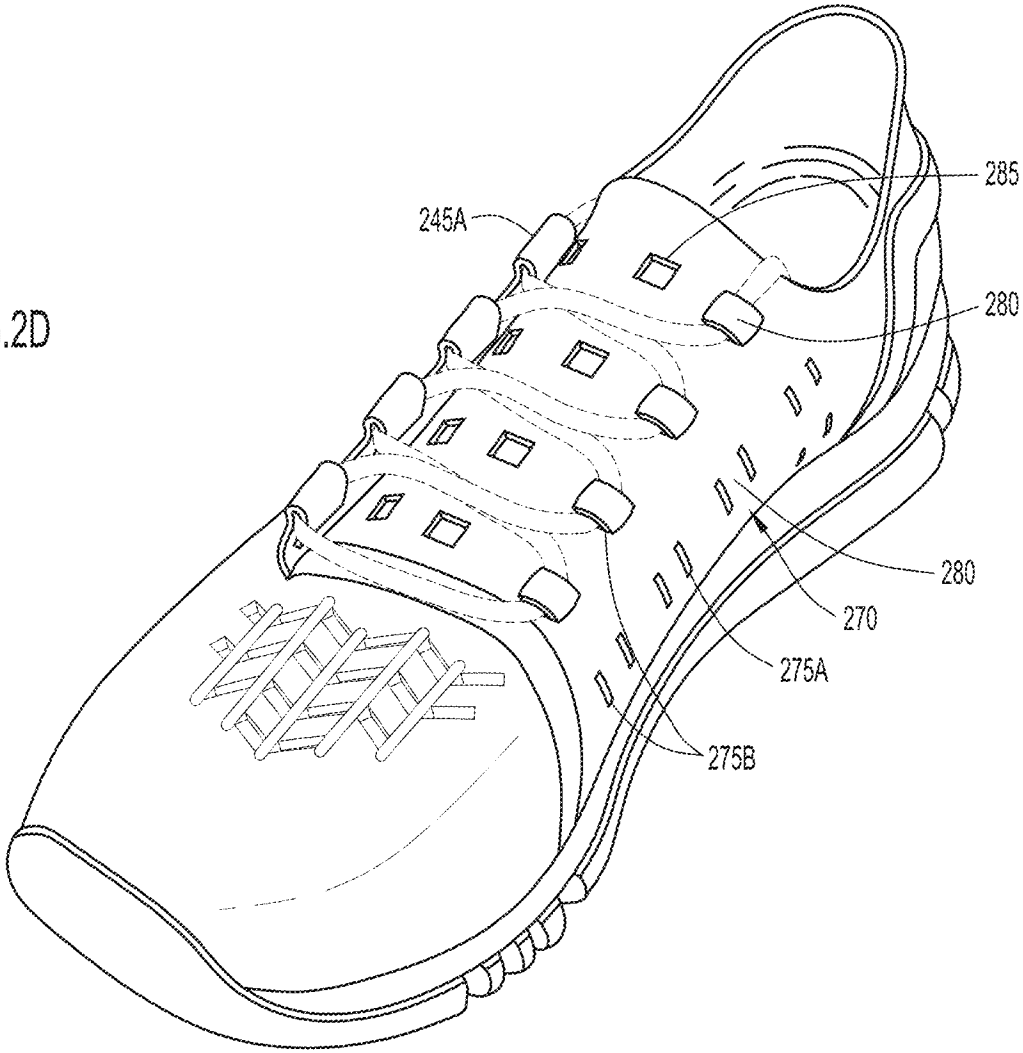
FIG. 2D is a front perspective view of the article of footwear shown in FIG. 1, showing the medial footwear side.
Figure 2E:
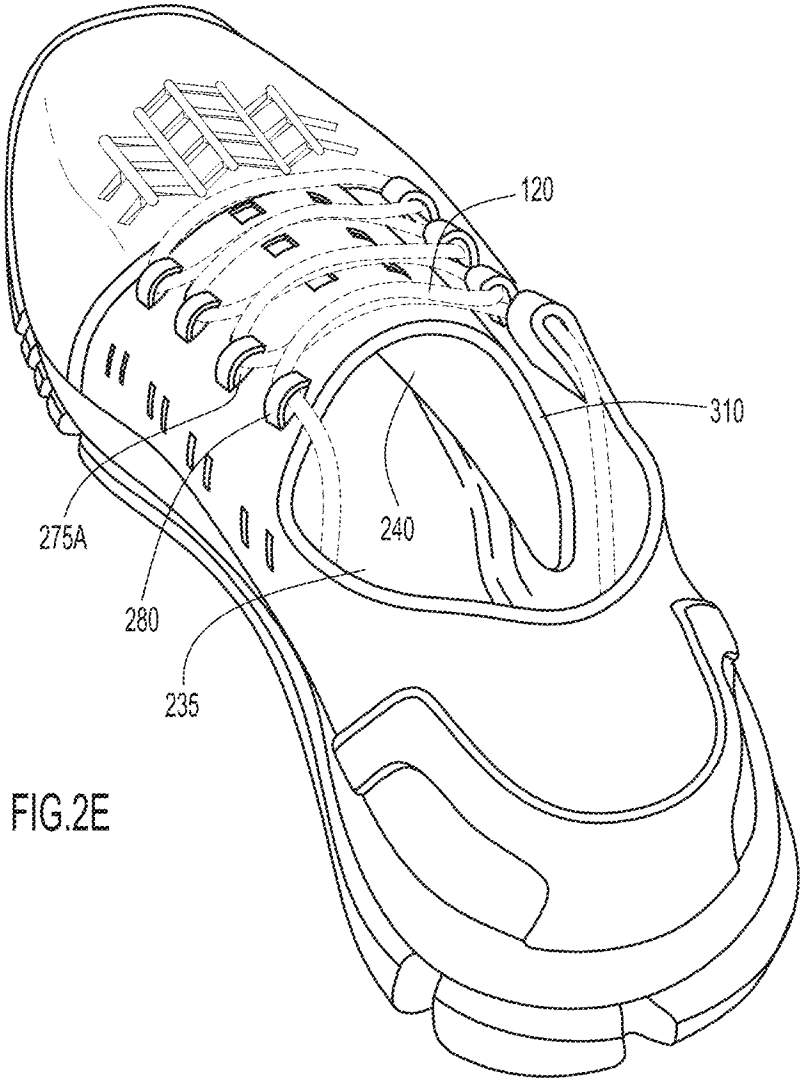
FIG. 2E is a rear perspective view of the article of footwear shown in FIG. 1, showing the medial footwear side.
Figure 3:
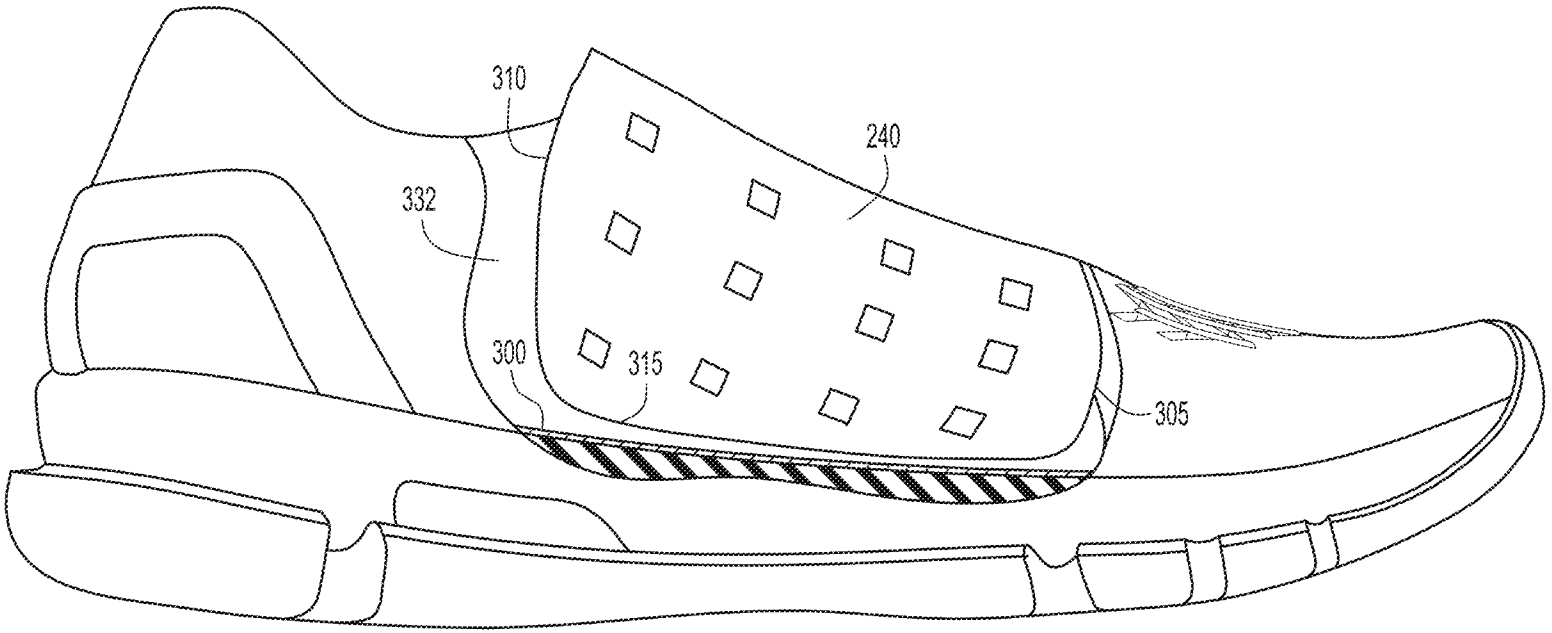
FIG. 3 is a side view in elevation of the article of footwear shown in FIG. 1, showing the lateral footwear side and further including a partial cut-out section.
Figure 4:
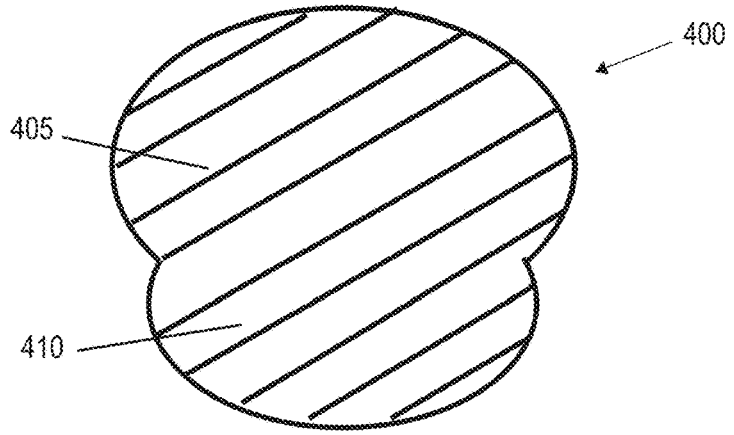
FIG. 4 is a cross-sectional view of a bicomponent fiber in accordance with an embodiment.

As described herein with reference to the example embodiment of FIGS. 1-3, an article of footwear 100 includes an upper 105 coupled to a sole structure 110 and further including a heel counter 115 and a fastening element or fastener 120 (e.g., a lace or cord, which is shown in phantom). The article of footwear 100 is an athletic shoe (e.g., a running shoe) defining a forefoot region 200A, a midfoot region 200B, and a hindfoot region 200C, as well as a medial side 205A and a lateral side 205B. The forefoot region 200A generally aligns with the ball and toes of the foot, the midfoot region 200B generally aligns with the arch and instep areas of the foot, and the hindfoot region 200C generally aligns with the heel and ankle areas of the foot. Additionally, the medial side 205A is oriented along the medial (big toe) side of the foot, while the lateral side 205B is oriented along the lateral (little toe) side of the foot.

The upper 105 includes and/or defines a plurality of sections that cooperate to define the foot cavity. A heel section 210 includes heel cup configured to align with and cover the calcaneus area of a human foot. A lateral quarter section 215, disposed forward the heel section 210, is oriented on the lateral shoe side 205B. Similarly, a medial quarter section 220, disposed forward the heel section 210, is oriented on the medial shoe side 205A. A vamp section 225 is disposed forward the quarter sections 215, 225; moreover, a toe cage section 230 is disposed forward the vamp section. The upper 105 may further include an instep cover section 240 configured to align and span the instep area of the foot as well as a planum section or footbed 300 (FIG. 3) that engages the planum (bottom) of the foot.

With this configuration, the heel 210, lateral quarter 215, medial quarter 220, vamp 225, toe cage 230 and planum 300 sections cooperate to form a foot cavity 332 (FIG. 3) into which a human foot is inserted by way of an access opening 235 formed cooperatively by the heel 210, the lateral 215 and medial 220 quarters, and the instep cover 240.

Referring to FIG. 2C, the lateral quarter section 215 extends from the heel section 210 to the vamp section 225, traveling upward from the planum section 300 such that the lateral quarter spans the lateral side of the foot, proximate the hindfoot and midfoot areas. The lateral quarter 215 may be formed integrally with the heel section 210, the vamp section 225, and the planum section 300. The lateral quarter 215 is adapted to receive a fastener such as a shoe lace. In an embodiment, the lateral quarter 215 includes a plurality of looped sections 245A, 245B, 245C, 245D disposed at the lateral quarter distal edge (upper edge). As illustrated, the looped sections 245A-245D are linearly spaced, being generally aligned in an array extending longitudinally along the shoe 100. In this manner, each looped section 245A-245D is configured to receive the fastener 120 (the shoe lace), movably capturing the fastener therein. The looped sections 245A-245D, moreover, cooperate with one or more elements disposed on the instep cover 240 to engage the fastener 120 (shown in phantom) to secure the shoe 100 to the foot of the wearer.

Referring to FIGS. 2D and 2E, the medial quarter 220 extends from the heel 210 to the vamp 225, traveling upward from the planum 300 such that the medial quarter spans the medial side of the foot, proximate the hindfoot and midfoot areas. The medial quarter 220 may be seamlessly and/or stitchlessly integrated with each of the heel 210, vamp, and planum 300 sections of the upper 105.

The instep cover 240 is configured to span the dorsum portion of the midfoot (i.e., the instep). The instep cover 240 may be formed integrally (stitchlessly and/or seamlessly) with the medial quarter section 220. As best seen in FIG. 3, the instep cover 240 defines a forward edge 305 (oriented toward the vamp 225) and a rearward edge 310 oriented generally parallel to the forward edge. The instep cover 240 further defines distal edge 315 oriented generally orthogonal to the forward and rearward edges. The instep cover 240 generally spans the instep of the foot, extending from the medial shoe side 205A to the lateral shoe side 205B, and extending from the throat line 250 of the vamp 225 at its forward edge 305 to the access opening 235 at its rearward edge 310. As noted above, the access opening 235 is partially defined by the rearward edge 310.

The instep cover 240 may include one or more narrow, elongated openings or slots 260 operable to permit passage of the fastener 120 therethrough. The instep cover 240 may also include additional openings or windows 285 operable to improve airflow into/out of the upper.

The forefoot region 200A of the upper 105 includes the vamp section 225, which extends forward from the lateral 215 and medial 220 quarters, being formed integrally therewith. The vamp section 225 includes the throat line 250 within its proximal region and toe cage 230 within its distal region, the toe cage being configured to span the toes of the foot.

In an embodiment, the upper 105 (or one or more sections) is a textile formed via knitting. Knitting is a process for constructing fabric by interlocking a series of loops (bights) of one or more strands organized in wales and courses. In general, knitting includes warp knitting and weft knitting. In warp knitting, a plurality of strands runs lengthwise in the fabric to make all the loops.

In weft knitting, one continuous strand runs crosswise in the fabric, making all of the loops in one course. Weft knitting includes fabrics formed on both circular knitting and flat knitting machines. With circular knitting machines, the fabric is produced in the form of a tube, with the strands running continuously around the fabric. With a flat knitting machine, the fabric is produced in flat form, the threads alternating back and forth across the fabric. In an embodiment, the upper 105 is formed via flat knitting utilizing stitches including, but not limited to, a plain stitch; a rib stitch, a purl stitch; a missed or float stitch (to produce a float of yarn on the fabric's wrong side); and a tuck stitch (to create an open space in the fabric). The resulting textile includes an interior side (the technical back) and an exterior side (the technical face), each layer being formed of the same or varying strands and/or stitches. By way of example, the textile may be a single knit/jersey fabric, a double knit/jersey fabric, and/or a plated fabric (with yarns of different properties are disposed on the face and back). In a specific embodiment, the upper textile is a double knit fabric formed via a flat knitting process.

Utilizing knitting, the entire upper 105 (or selected sections) may be configured as a unitary structure (i.e., it may possess a unibody construction) to minimize the number of seams utilized to form the shape of the upper. For example, the upper 105 may be formed as a one-piece template, each template portion being integral with adjacent template portions. Accordingly, each section 210, 215, 220, 225, 230, 240, 300 of the upper 105 may include a common strand interconnecting that section with adjacent sections (i.e., the common strand spans both sections). In addition, the connection between adjacent sections may be stitchless and seamless. By stitchless and/or seamless, it is meant that adjacent sections are continuous or integral with each other, including no edges that require joining by stitches, tape, adhesive, welding (fusing), etc.

The strands forming the knitted textile (and thus the upper 105) may be any natural or synthetic strands suitable for their described purpose (i.e., to form a knit upper). The term "strand" includes one or more filaments organized into a fiber and/or an ordered assemblage of textile fibers having a high ratio of length to diameter and normally used as a unit (e.g., slivers, roving, single yarns, plies yarns, cords, braids, ropes, etc.). In a preferred embodiment, a strand is a yarn, i.e., a continuous strand of textile fibers, filaments, or material in a form suitable for knitting, weaving, or otherwise intertwining to form a textile fabric. A yarn may include a number of fibers twisted together (spun yarn); a number of filaments laid together without twist (a zero-twist yarn); a number of filaments laid together with a degree of twist; and a single filament with or without twist (a monofilament).

The strands may be heat sensitive strands such as flowable (fusible) strands and softening strands. Flowable strands are include polymers that possess a melting and/or glass transition point at which the solid polymer liquefies, generating viscous flow (i.e., becomes molten). In an embodiment, the melting and/or glass transition point of the flowable polymer may be approximately 80° C. to about 150° C. (e.g., 85° C.). Examples of flowable strands include thermoplastic materials such as polyurethanes (i.e., thermoplastic polyurethane or TPU), ethylene vinyl acetates, polyamides (e.g., low melt nylons), and polyesters (e.g., low melt polyester). Preferred examples of melting strands include TPU and polyester. As a strand becomes flowable, it surrounds adjacent strands. Upon cooling, the strands form a rigid interconnected structure that strengthens the textile and/or limits the movement of adjacent strands.

Softening strands are polymeric strands that possess a softening point (the temperature at which a material softens beyond some arbitrary softness). Many thermoplastic polymers do not have a defined point that marks the transition from solid to fluid. Instead, they become softer as temperature increases. The softening point is measured via the Vicat method (ISO 306 and ASTM D 1525), or via heat deflection test (HDT) (ISO 75 and ASTM D 648). In an embodiment, the softening point of the strand is from approximately 60° C. to approximately 90° C. When softened, the strands become tacky, adhering to adjacent stands. Once cooled, movement of the textile strands is restricted (i.e., the textile at that location stiffens).

One additional type of heat sensitive strand which may be utilized is a thermosetting strand. Thermosetting strands are generally flexible under ambient conditions, but become irreversibly inflexible upon heating.

The strands may also include heat insensitive strands. Heat insensitive strands are not sensitive to the processing temperatures experienced by the upper (e.g., during formation and/or use). Accordingly, heat insensitive strands possess a softening, glass transition, or melting point value greater than that of any softening or melting strands present in the textile structure and/or greater than the temperature ranges specified above.

The upper 105 further includes a strand formed of non-elastomeric material, i.e., an inelastic strand. In conventional uppers, elastic strands are utilized to provide a textile upper with stretch and recovery properties. An elastic strand is formed of elastomeric material (e.g., rubber or a synthetic polymer having properties of rubber). Accordingly, an elastic strand possesses the ability to stretch and recover by virtue of its composition. A specific example of an elastomeric material suitable for forming an elastic strand is an elastomeric polyester-polyurethane copolymer such as elastane, which is a manufactured fiber in which the fiber-forming substance is a long chain synthetic polymer composed of at least 85% of segmented polyurethane.

The degree to which fibers, yarn, or cord returns to its original size and shape after deformation indicates how well a fabric/textile recovers. Even when utilized, the upper does not quickly recover to its original size and shape. Sagging will develop within the upper over time, caused by the incomplete recovery within the structure. An elastic strand such as elastane, moreover, retains water, potentially creating wearer discomfort. In addition, elastane must be braided onto an existing yarn or completed covered by another fiber, increasing the weight of the textile (i.e., it cannot be the sole component of a course within the knit structure).

In contrast, an inelastic is formed of a non-elastomeric material. Accordingly, by virtue of its composition, inelastic strands possess no inherent stretch and/or recovery properties. Hard yarns are examples of inelastic strands. Hard yarns include natural and/or synthetic spun staple yarns, natural and/or synthetic continuous filament yarns, and/or combinations thereof By way of specific example, natural fibers include cellulosic fibers (e.g., cotton, bamboo) and protein fibers (e.g., wool, silk, and soybean). Synthetic fibers include polyester fibers (poly(ethylene terephthalate) fibers and poly(trimethylene terephthalate) fibers), polycaprolactam fibers, poly(hexamethylene adipamide) fibers, acrylic fibers, acetate fibers, rayon fibers, nylon fibers and combinations thereof.

Figure 6:
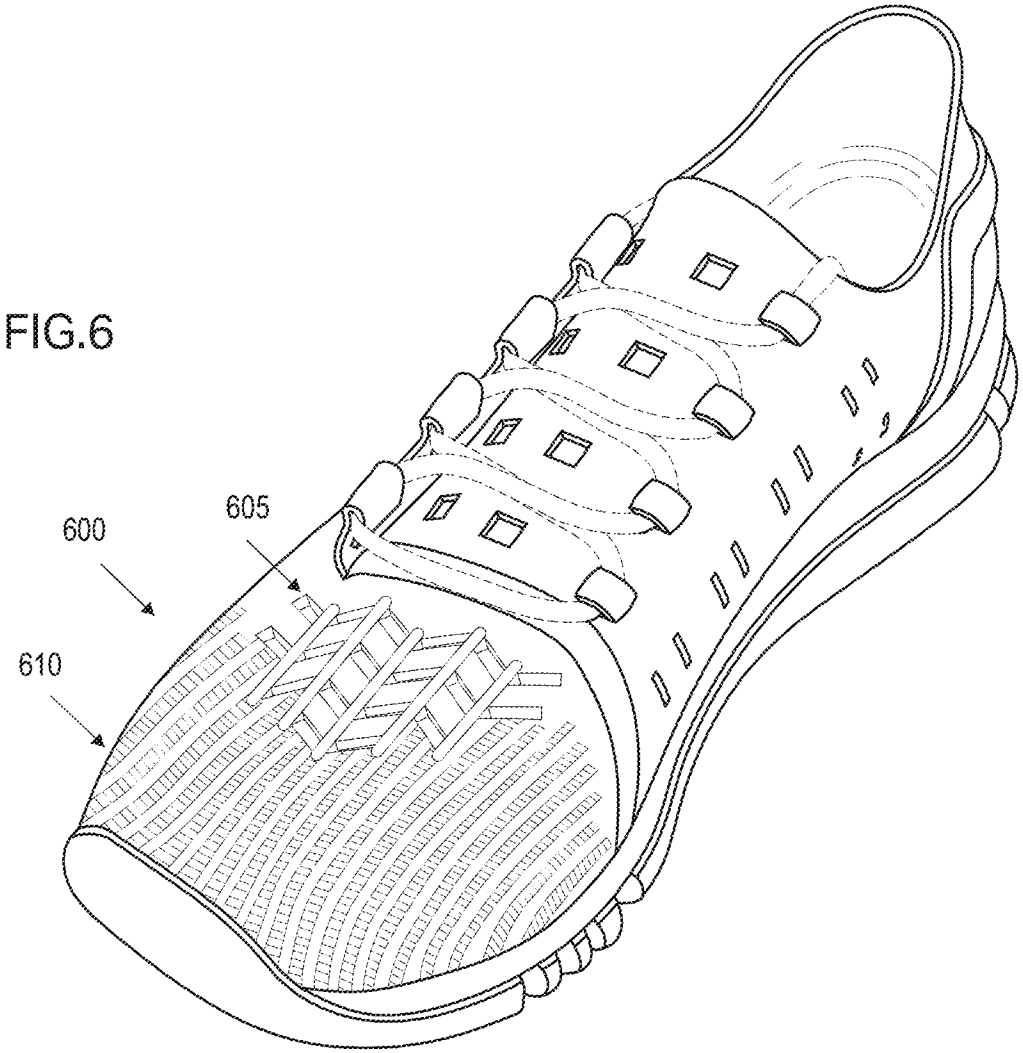
FIG. 6 is a front perspective view of an article of footwear in accordance with an embodiment of the invention.

The upper 105 includes an inelastic strand possessing a topology that enables it to provide mechanical stretch and recovery within the knit structure. In an embodiment, the inelastic strand is a hard yarn texturized to generate stretch within the yarn. In a preferred embodiment, the inelastic strand is a bicomponent strand formed of two polymer components, each component possessing differing properties. The components may be organized in a sheath-core structure. Alternatively, the components—also called segments—may be oriented in a side-by-side (bilateral) relationship, being connected along the length of the strand. As seen in FIG. 6, the bicomponent strand 400 is a filament including a first polymer segment 405 and a second polymer segment 410. While the components may be symmetrical, in the illustrated embodiment, the strand is eccentric (the polymer components are asymmetrical), with the first polymer component 405 possessing more volume and/or mass than the second polymer component 410. It should be understood, however, that the segments may be generally similar in dimensions (size, shape, volume, etc.).

In a further embodiment, the first polymer component of 405 is formed of a polymer possessing a first shrinkage rate (when exposed to wet or dry heat) and the second polymer component 410 is formed of a polymer possessing second shrinkage rate. Accordingly, when the strand 400 is exposed to heat, the polymer components 405, 410 shrink at different rates, generating coils within the strand 400.

By way of example, the strand 400 is a polyester bicomponent strand. A polyester bicomponent strand is a continuous filament having a pair of polyesters connected side-by-side, along the length of the filament. Specifically, the polyester bicomponent strand 400 may include a poly(trimethylene terephthalate) and at least one polymer selected from the group consisting of poly(ethylene terephthalate), poly(trimethylene terephthalate), and poly(tetramethylene terephthalate) or a combination thereof. By way of example, the polyester bicomponent filaments include poly(ethylene terephthalate) and poly(trimethylene terephthalate) in a weight ratio of about 30/70 to about 70/30. In a preferred embodiment, the first polyester component 405 is a 2GT type polyester polyethylene terephthalate (PET) and the second polyester component 410 is a 3GT type polyester (e.g., polytrimethylene terephthalate (PTT)). In an embodiment, the 2GT type polyester forms about 60 wt % of the strand, while the 3GT type polyester forms about 40 wt % of the strand. As noted above, the strand 400 may be in the form of, without limitation, a single filament or a collection of filaments twisted into a yarn.

Additionally, various co-monomers can be incorporated into the polyesters of the bicomponent strand 400 in minor amounts, provided such co-monomers do not have an adverse effect on the amount of strand coiling. Examples include linear, cyclic, and branched aliphatic dicarboxylic acids (and their diesters) having 4-12 carbon atoms; aromatic dicarboxylic acids (and their esters) having 8-12 carbon atoms (for example isophthalic acid, 2,6-naphthalenedicarboxylic acid, and 5-sodium-sulfoisophthalic acid); and linear, cyclic, and branched aliphatic diols having 3-8 carbon atoms (for example 1,3-propane diol, 1,2-propanediol, 1,4-butanediol, 3-methyl-1,5-pentanediol, 2,2-dimethyl-1,3-propanediol, 2-methyl-1,3-propanediol, and 1,4-cyclohexanediol), isophthalic acid, pentanedioic acid, 5-sodium-sulfoisophthalic acid, hexanedioic acid, 1,3-propane diol, and 1,4-butanediol are preferred. The polyesters can also contain additives, such as titanium dioxide.

With the above configuration, when exposed to heat, the first polymer (polyester) component 405 shrinks/contracts at a different rate than the second polymer (polyester) component 410. This, in turn, produces a regular, helical coil along the length of the strand 400. In an embodiment, the contraction value of each polymer segment 405, 410 may range from about 10% to about 80% (from its original diameter). The strand 400 may possess an after-heat-set crimp contraction value from about 30% to about 60%.

The helical coil of the strand 400 generates non-elastomeric, mechanical stretch and recovery properties within the strand (e.g., the filament or yarn). That is, the strand possesses mechanical stretch and recovery without the need to texturize the strand, which reduces strand durability. A bicomponent strand, moreover, possesses increased recovery properties compared to elastic strands at stretch levels of less than 25%. The recovery power of elastic strands increases with increasing stretch (e.g., 100% or more). Stated another way, the further an elastic strand is stretched, the better it recovers. At low stretch levels, elastic strands generate low recovery power. This is a disadvantage in footwear uppers, where the amount of stretch required during use is minimal (e.g., less than 25%).

The bicomponent strand 400 may possess any dimensions suitable for its described purpose. By way of example, the bicomponent strands 400 may be present within the textile as yarn having a denier of from about 70 denier to about 900 denier (78 dtex to 1000 dtex) and, in particular, from about 100 denier to about 450 denier.

The entire upper 105 or sections thereof may be formed completely of bicomponent strands. In an embodiment, the upper 105 is formed with a combination of bicomponent strands and non-bicomponent strands such as heat sensitive strands. The bicomponent strand can be present from about 20% by weight to about 95% by weight (e.g., about 25%— about 75% by weight) based on the total weight of the textile structure (the entire upper 105 or sections thereof). Stated another way, the ratio of the bicomponent strand 400 to other strands within the structure may be about 10:1 to about 1:10 (e.g., 1:1).

Figure 5:
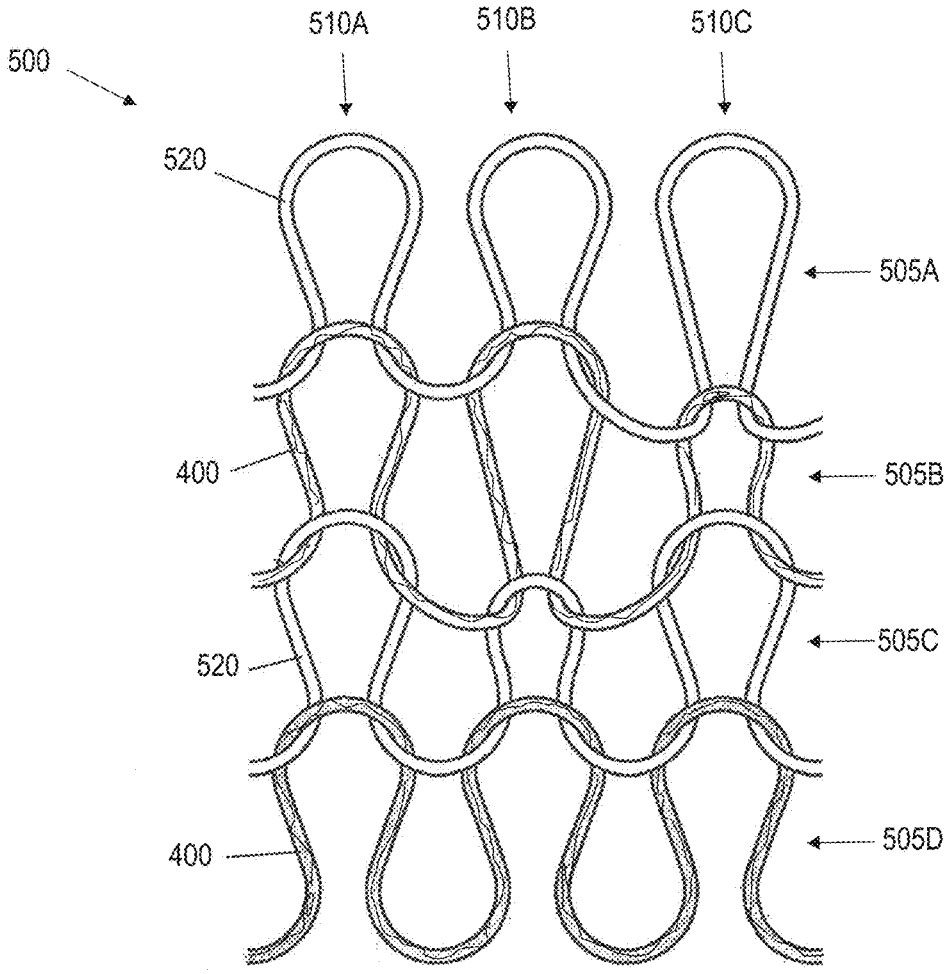
FIG. 5 is a schematic of an exemplary knit construction.

In operation, a bicomponent strand 400 forms a course within the textile structure. Referring to FIG. 5, the knit structure 500 of the upper includes a plurality of courses 505A, 505B, 505C, and 505D and a plurality of wales 510A, 510B, 510C. Each course 505A, 505B, 505C, and 505D is formed of a strand. In an embodiment, the knit structure 500 includes a first, bicomponent strand 400 and a second, non-bicomponent strand 520. In the illustrated embodiment, courses 505B and 505D are formed of the bicomponent strand 400, while courses 505A and 505C are formed of the non-bicomponent strand 520.

While the illustrated embodiment shows the bicomponent strand 400 forming alternating courses of the knit structure 500, it should be understood that the bicomponent strand 400 or the non-bicomponent strand 520 may form a plurality of successive courses 505 within the knit structure. For example, the textile structure 500 includes a plurality of bicomponent strands 400 courses, each bicomponent strand course being spaced a predetermined number of courses away from an adjacent bicomponent strand course. In general, the bicomponent strand 400 may form approximately every second course to approximately every 10th course. Typically, the spacing remains consistent throughout the textile structure 100. In other embodiments, the spacing of the bicomponent strand 400 may be varied to alter the recovery and/or stretch properties throughout the knit structure 500 (and thus the textile). By way of specific example, the bicompoent strand 400 may form every other course of the upper 105 along the toe cage section, but form every sixth course along the heel section.

The vamp 225 may further include a microclimate modulation structure operable to affect movement of heat, air, and/or moisture (e.g., vapor) within the foot cavity 332. The temperature modulation structure includes strands selected to possess predetermined thermal conductivity values positioned at selected locations within the knit construction of the textile. Referring to FIG. 6, includes a first construction or portion 605 possessing a first knit construction and a second construction or portion 610 possessing a second knit construction. The first portion 605 forms the central area of the vamp 225, being oriented forward the throat line 250, with its lateral boundaries generally coextensive therewith, and its forward boundary located proximate the toe cage 230. The second portion 610 partially surrounds the first portion 405, being oriented along its forward, medial, and lateral sides. Stated another way, the second portion 610 forms the toe cage 230, the lateral side of the vamp 225, and the medial side of the vamp. As illustrated, the first portion 605 is integral with the second portion 610 with a seamless and/or stitchless transition therebetween. Each portion 605, 610 of the microclimate modulation structure 400 is independently capable of affecting the movement of heat, air, and/or moisture within the cavity and/or exhausting it from the foot cavity 332.

In an embodiment, the temperature modulation structure 600 includes first, high thermal conductivity strands and second, low thermal conductivity strands. High conductivity strands are strands that transfer heat along its length (axis) and/or width (transverse dimension) at a higher rate than low thermal conductivity strands. In an embodiment, high thermal conductivity strands are strands formed (e.g., entirely formed) of material possessing a thermal conductivity value greater than 0.40 W/m K. By way of example, the strands may be formed of high density polyethylene (HDPE, 0.45-0.52 @23C) and/or ultra-high molecular weight polyethylene (UWMW-PE, 0.42-0.51 W/m K @23C).

In a further embodiment, high thermal conductivity strand is a strand that possessing an axial thermal conductivity of at least 5 W/m K (e.g., at least 10 W/m K or at least 20 W/m K). The high thermal conductivity strand may be a multi-filament fiber such as a gel-spun fiber. By way of specific example, the high conductivity strand is a gel-spun, multi-filament fiber produced from ultra-high molecular weight polyethylene (UHMW-PE), which possesses a thermal conductivity value in the axial direction of 20 W/m K (DYNEEMA, available from DSM Dyneema, Stanley, N.C.).

The low thermal conductivity strand, in contrast, transfers heat along its length (axis) and/or width (transverse dimension) at a lower rate than that of the high thermal conductivity strand. In an embodiment, the low thermal conductivity strand is formed (e.g., entirely formed) of material possessing a thermal conductivity of no more than 0.40 W/m K. By way of example, the low conductivity strand may be formed of low density polyethylene (LDPE, 0.33 W/m K @23C), nylon (e.g., nylon 6; nylon 6,6; or nylon 12) (0.23-0.28 W/m K @23° C.), polyester (0.15-0.24 W/m K @23° C.), and/or polypropylene (0.1-0.22 W/m K @23C).

In another embodiment, the low thermal conductivity strand possesses an axial thermal conductivity (as measured along its axis) that is less than the axial conductivity of the high conductivity strands. By way of example, the low thermal conductivity strands possess an axial thermal conductivity value of less than 5 W/m K when high thermal conductivity strand possesses a thermal conductivity of greater than 5 W/m K; of less than 10 W/m K when high conductivity strand possesses a thermal conductivity of at least 10 W/m K; and/or less than 20 W/m K when high conductivity strand possesses a thermal conductivity of greater than 20 W/m K. Exemplary low thermal conductivity strands include strands formed of polyester staple fibers (axial thermal conductivity: 1.18 W/m K); polyester filament strands (axial thermal conductivity: 1.26 W/m K); nylon fiber strands (axial thermal conductivity: 1.43 W/m K); polypropylene fiber strands (axial thermal conductivity: 1.24 W/m K); cotton strands (axial thermal conductivity: 2.88 W/m K); wool strands (axial thermal conductivity: 0.48 W/m K); silk strands (axial thermal conductivity: 1.49 W/m K); rayon strands (axial thermal conductivity: 1.41-1.89 W/m K); and aramid strands (axial thermal conductivity: 3.05-4.74 W/m K), as well as combinations thereof.

The sole structure 110 comprises a durable, wear-resistant component configured to provide cushioning as the shoe 100 impacts the ground. In certain embodiments, the sole structure 110 may include a midsole and an outsole. In additional embodiments, the sole structure 110 can further include an insole that is disposed between the midsole and the upper 105 when the shoe 100 is assembled. In other embodiments, the sole structure 110 may be a unitary and/or one-piece structure. As can be seen, e.g., in the exploded view of FIG. 1, the sole structure 110 includes an upper facing side 125 and an opposing, ground-facing side 130. The upper facing side 125 may include a generally planar surface and a curved rim or wall that defines the sole perimeter for contacting the bottom surface 135 of the upper 105. The ground-facing side 130 of the sole structure 110 can also define a generally planar surface and can further be textured and/or include ground-engaging or traction elements (e.g., as part of the outsole of the sole structure) to enhance traction of the shoe 100 on different types of terrains and depending upon a particular purpose in which the shoe is to be implemented. The ground-facing side 130 of the sole structure 110 can also include one or more recesses formed therein, such as indentations or grooves extending in a lengthwise direction of the sole structure 110 and/or transverse the lengthwise direction of the sole structure, where the recesses can provide a number of enhanced properties for the sole structure (e.g., flexure/pivotal bending along grooves to enhance flexibility of the sole structure during use).

The sole structure 110 may be formed of a single material or may be formed of a plurality of materials. In example embodiments in which the sole structure includes a midsole and an outsole, the midsole may be formed of one or more materials including, without limitation, ethylene vinyl acetate (EVA), an EVA blended with one or more of an EVA modifier, a polyolefin block copolymer, and a triblock copolymer, and a polyether block amide. The outsole may be formed of one or more materials including, without limitation, elastomers (e.g., thermoplastic polyurethane), siloxanes, natural rubber, and synthetic rubber.

With the above-described configuration, an upper formed of a knit textile may be provided with stretch and recovery properties without the use of strands/yarns formed of elastomeric material such as rubber or elastane. In embodiments, no strands possessing elastomeric stretch are present within the textile structure (i.e., the entire footwear upper and/or an entire section of the footwear upper). Eliminating elastomeric strands improves the overall weight of the upper since it is no longer necessary to plait (braid) elastomeric strands onto an existing strand forming the course. Instead, the bicomponent strand is the only strand forming the course.

Figure 7:
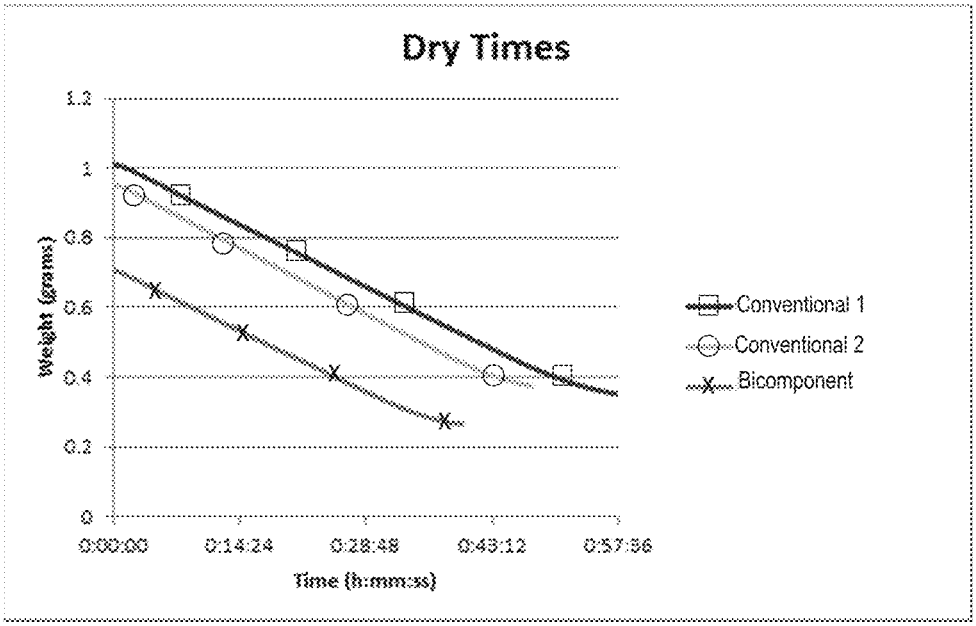
FIG. 7 is a graph illustrating dry times of knitted textile including bicomponent fiber compared to knitted textile lacking bicomponent fiber.

Additionally, elastomeric strands capture water. Accordingly, an upper containing no elastomeric strands provides an upper that dries quicker than conventional uppers including elastomeric strands. Referring to FIG. 7, a comparison of textile structures lacking elastomeric strands to textile structures including elastomeric yarns is provided. Specifically, a textile including spun polyester and a bicomponent polyester (about 25% bicomponent fiber) was compared to a first textile structure (Conventional #1) including 95% cotton fiber and 5% elastane fiber (plaited onto the cotton) and a second textile structure (Conventional #2) including 60% cotton, 40% polyester, and 5% elastane (plaited onto the cotton and/or polyester). As shown, the knit structure including bicomponent strands was not only lighter in weight, but dried quicker than the conventional knit structures.

Figure 8:
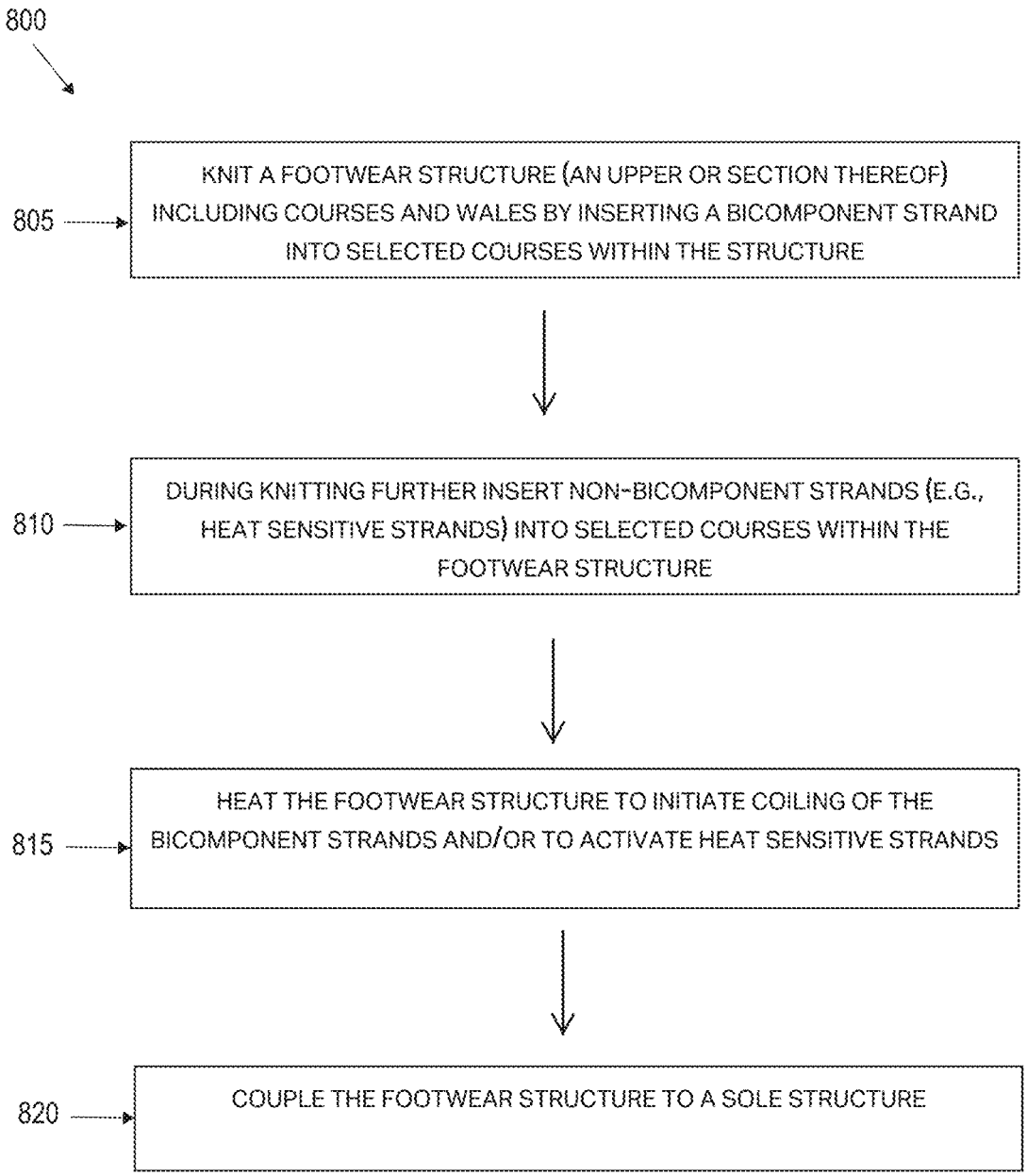
FIG. 8 is a flow chart disclosing a method of forming an article of footwear.

A method of forming an article of footwear is disclosed with reference to FIG. 8. As shown, the process 800 includes (Step 805) knitting a footwear structure including courses and wales by inserting a bicomponent strand into selected courses within the structure. As explained above, the bicomponent strand includes a first component polymer integrally formed with a second component polymer. At step 810, a non-bicomponent strand is inserted into selected courses within the footwear structure. As explained above, a non-bicomponent strand includes the inelastic, heat sensitive, heat insensitive strands discussed above, as well as the low and/or high thermal conductivity strands. At Step 815, upon formation of the knitted footwear structure, the footwear structure is exposed to wet or dry heat. The temperature should be sufficient to activate the bicomponent strand, generating coiling within the strand. In addition, when thermally sensitive strands are present, the temperature applied should be sufficient to initiate softening (when a softening strand), melting (when a fusible strand), or setting (when a thermosetting strand). After heating, at Step 820, the resulting footwear structure (e.g., the upper) may be coupled to the upper via adhesives, stitching, etc.

While the invention has been described in detail and with reference to specific embodiments thereof, it will be apparent to one skilled in the art that various changes and modifications can be made therein without departing from the spirit and scope thereof. For example, while most of the example embodiments depicted in the figures show an article of footwear (shoe) configured for a right foot, it is noted that the same or similar features can also be provided for an article of footwear (shoe) configured for a left foot (where such features of the left footed shoe are reflection or "mirror image" symmetrical in relation to the right footed shoe).

While not being elastomeric, the bicomponent strand 400 still possesses good stretch and recovery. While a recoverable stretch of 25% is suggested above, other recoverable stretch ranges may be utilized. For example, a recoverable stretch of at least 75%, preferably at least 100%, and more preferably up to 150% or more (per, e.g., ASTM D6720-07)). In an embodiment, the bicomponent strand recovers rapidly and substantially to its original length when stretched to one and half times its original length (150%) and released.

The footwear upper 105 or a portion of the footwear upper (e.g., one of the sections 210, 215, 220, 225, 230, 240, 300) may include a course of bicomponent strand 400. As noted above, the footwear upper 105 or a portion of the footwear upper (e.g., one of the sections 210, 215, 220, 225, 230, 240, 300) may be formed primarily (e.g., >50%), substantially (e.g., >90%), or completely (100%) of bicomponent strands (with any remainder being non-bicomponent strands).

Within the knit structure, various stitches may be used to provide different sections 210, 215, 220, 225, 230, 240, 300 of the upper 105 with different properties. For example, a first area may be formed of a first stitch configuration, and a second area may be formed of a second stitch configuration that is different from the first stitch configuration to impart varying textures, structures, patterning, and/or other characteristics to the upper member.

Stitching may be utilized to connect sections of the upper together. In addition, a thermoplastic film may be utilized to reinforce seams, replace stitching, and/or prevent fraying. For example, seam tape available from Bemis Associates, Inc. (Shirley, Mass.) may be utilized. Instead of an instep cover 240, the upper 105 may include a conventional tongue including a longitudinally extending member free on its lateral and medial sides.

It is to be understood that terms such as "top", "bottom", "front", "rear", "side", "height", "length", "width", "upper", "lower", "interior", "exterior", "inner", "outer", and the like as may be used herein, merely describe points of reference and do not limit the present invention to any particular orientation or configuration.

Thus, it is intended that the present invention covers the modifications and variations of this invention provided they come within the scope of the appended claims and their equivalents.

What is claimed:

1. An article of footwear including a foot cavity, the article of footwear comprising:

a sole structure; and an upper coupled to the sole structure, the upper defining a forward section including a toe cage section, a rearward section including a heel section, and an intermediate section disposed between the forward section and the rearward section, the upper comprising a knit structure with strands oriented in courses and wales, the strands including a plurality of bicomponent strands and a plurality of non-bicomponent strands, wherein a course spacing between individual bicomponent strands differs between the toe cage section and the heel section such that a first number of courses that separates each bicomponent strand from a nearest bicomponent strand within a portion of the toe cage section differs from a second number of courses that separates each bicomponent strand from a nearest bicomponent strand within a portion of the heel section, each bicomponent strand of the plurality of bicomponent strands comprising a first component polymer integrally formed with a second component polymer, the polymer components being oriented in side-by-side relationship along the length of the bilateral strand, wherein the knit structure excludes elastomeric strands, and the first component polymer possesses a first rate of shrinkage and the second component polymer possesses a second rate of shrinkage, the first rate of shrinkage differing from the second rate of shrinkage such that, when each bicomponent strand is subjected to heat, coils are generated within the bicomponent strand to impart non-elastomeric, mechanical and stretch properties for the bicomponent strand such that the bicomponent strand is capable of recovering substantially to its original length upon being stretched.

2. The article of footwear according to claim 1, wherein each bicomponent strand of the plurality of bicomponent strands is a polyester bicomponent strand comprising a first component polymer of poly(trimethylene terephthalate) and a second component polymer selected from the group consisting of poly(ethylene terephthalate), poly(tetramethylene terephthalate), and combinations thereof.

3. An article of footwear including a foot cavity, the article of footwear comprising:

a sole structure; and an upper coupled to the sole structure, the upper defining a forward section including a toe cage section, a rearward section including a heel section, and an intermediate section disposed between the forward section and the rearward section, the upper comprising a knit structure with strands oriented in courses and wales, the strands including a plurality of bicomponent strands and a plurality of non-bicomponent strands, wherein a course spacing between individual bicomponent strands differs between the toe cage section and the heel section such that a first number of courses that separates each bicomponent strand from a nearest bicomponent strand within a portion of the toe cage section differs from a second number of courses that separates each bicomponent strand from a nearest bicomponent strand within a portion of the heel section, each bicomponent strand of the plurality of bicomponent strands comprises a coiled strand including a first polymer segment integrally formed with a second polymer segment such that the polymer segments are oriented in side-by-side relationship along the length of the bilateral strand, and wherein the bicomponent strand is configured to recover substantially to its original length upon being stretched; and wherein each of the first number of courses and the second number of courses, independently from each other, is from every second course to every tenth course.

* * * * *